US008439627B2

(12) United States Patent
Inomata et al.

(10) Patent No.: US 8,439,627 B2
(45) Date of Patent: May 14, 2013

(54) STEAM TURBINE AND COOLING METHOD THEREOF

(75) Inventors: Asako Inomata, Kanagawa-ken (JP); Katsuya Yamashita, Tokyo (JP); Kazuhiro Saito, Kanagawa-ken (JP); Takao Inukai, Kanagawa-ken (JP); Kazutaka Ikeda, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 671 days.

(21) Appl. No.: 12/686,129

(22) Filed: Jan. 12, 2010

(65) Prior Publication Data

US 2010/0178155 A1 Jul. 15, 2010

(30) Foreign Application Priority Data

Jan. 14, 2009 (JP) ..... 2009-005763

(51) Int. Cl.
*F01D 5/08* (2006.01)
*F01D 5/18* (2006.01)

(52) U.S. Cl.
USPC ..... 415/1; 415/115; 416/1; 416/97 R; 416/204 R; 416/219 R; 416/220 R

(58) Field of Classification Search ..... 416/1, 96 R, 416/97 R, 204 R, 219 R, 220 R; 415/1, 115
See application file for complete search history.

(56) References Cited

U.S. PATENT DOCUMENTS

| | | | | | |
|---|---|---|---|---|---|
| 3,045,968 | A * | 7/1962 | Willis | 416/219 R |
| 3,112,914 | A * | 12/1963 | Wellman | 416/219 R |
| 4,169,694 | A * | 10/1979 | Sanday | 416/219 R |
| 4,824,328 | A * | 4/1989 | Pisz et al. | 416/219 R |
| 5,088,894 | A * | 2/1992 | Patel | 416/219 R |
| 5,160,242 | A * | 11/1992 | Brown | 416/193 A |
| 5,511,945 | A * | 4/1996 | Glezer et al. | 416/96 R |
| 5,741,119 | A * | 4/1998 | Heppenstall | 416/219 R |
| 7,905,709 | B2 * | 3/2011 | Lagrange et al. | 416/219 R |
| 2003/0044284 | A1 | 3/2003 | Leeke et al. | |
| 2006/0275125 | A1 * | 12/2006 | Bibor et al. | 416/193 A |
| 2008/0286109 | A1 * | 11/2008 | Keith et al. | 416/239 |

FOREIGN PATENT DOCUMENTS

| | | | |
|---|---|---|---|
| GB | 1183835 | A | 3/1970 |
| JP | 57-162903 | U | 4/1956 |
| JP | 58-081301 | U | 6/1983 |
| JP | 11-200801 | A | 7/1999 |

* cited by examiner

*Primary Examiner* — Igor Kershteyn
(74) *Attorney, Agent, or Firm* — Foley & Lardner LLP

(57) ABSTRACT

A steam turbine includes a casing, a rotor arranged inside the casing so as to extend in an axial direction of the casing, a rotor disk integrally formed with the rotor, a rotor-side implanting portion formed in the rotor disk, a plurality of moving blades arranged on the rotor disk in a circumferential direction of the rotor, and a moving blade-side implanting portion formed in the moving blade, in which the moving blade-side implanting portions of the moving blades are engaged with the rotor-side implanting portions, respectively. A cooling medium flows through a gap formed at least on a blade portion side of the moving blade among gaps formed between the moving blade-side implanting portions and the rotor-side implanting portions.

8 Claims, 7 Drawing Sheets

STEAM TURBINE AND COOLING METHOD THEREOF

BACKGROUND OF THE INVENTION

1. Field of the Invention

The present invention relates to a steam turbine and a cooling method thereof, more particularly, to a steam turbine that uses high-temperature steam having a steam temperature of about 700 to 750° C.

2. Description of the Related Art

Steam turbines using mainstream steam having a temperature of about 600° C. have been put to practical use from the viewpoint of improvement in turbine efficiency. To further improve the turbine efficiency, steam turbines having a temperature of mainstream steam increased to about 700 to 750° C. have been studied and developed.

Since the steam turbine uses the mainstream steam having a high temperature, heat-resistant alloy needs to be used as in a gas turbine. However, since the heat-resistant alloy is expensive and it is also difficult to manufacture a large component or parts from the heat-resistant alloy, it is hard to use heat-resistant alloy, and hence, in a certain case, the material strength of the steam turbine may be reduced due to the high-temperature steam. In this case, it is necessary to cool turbine constituent components.

As shown in FIG. 6, as generally known, a steam turbine includes rotor-side implanting portions 51 formed on a rotor disk 50 that is integrally formed with a rotor, not shown, and moving blade-side implanting portions 52 are formed on moving blades, not shown. There is hence known such a steam turbine, in which each of the moving blade-side implanting portions 52 is inserted into a groove 53 between the adjacent rotor-side implanting portions 51 from the axial direction of the rotor, so that the moving blade-side implanting portions 52 are engaged with the rotor-side implanting portions 51.

As one of the steam turbines as described above, Patent Document 1 (Japanese Patent Laid-Open Publication No. 11-200801) discloses a steam turbine in which a cooling passage 55 is formed between a groove bottom surface 54 of the groove 53 between the adjacent rotor-side implanting portions 51 and a lower end portion of each of the moving blade-side implanting portions 52 as indicated by two-dot-chain line in FIG. 6.

The rotor-side implanting portions 51 and the moving blade-side implanting portions 52 can be cooled by flowing the cooling steam through the cooling passages 55.

However, as described in Patent Document 1, in the case when the cooling steam is made to flow only through the cooling passages 55 each enclosed by the groove bottom surface 54 of the groove 53 between the adjacent rotor-side implanting portions 51 and the lower end portion of each of the moving blade-side implanting portions 52, it is difficult to shut out heat which is conducted from blade portions of the moving blades to enter the rotor-side implanting portions 51 and the moving blade-side implanting portions 52. In fact, in an actual operation, it is difficult to effectively cool down the rotor-side implanting portions 51 and the moving blade-side implanting portions 52. As a result, there causes a fear that the rotor-side implanting portions 51 and the moving blade-side implanting portions 52 may be reduced in strength due to the heat of high-temperature steam.

SUMMARY OF THE INVENTION

In consideration of the circumstances encountered in the prior art mentioned above, it is an object of the present invention to provide a steam turbine and a cooling method thereof capable of ensuring the strength of a implanting portion of each of a moving blade and a rotor disk, and securing its soundness even when high-temperature steam is used as mainstream steam.

The above and other objects of the present invention can be achieved by providing, in one aspect, a steam turbine comprising:

a casing;

a rotor arranged inside the casing so as to extend in an axial direction of the casing;

a rotor disk integrally formed with the rotor;

a rotor-side implanting portion formed in the rotor disk;

a moving blade; and a moving blade-side implanting portion formed in the moving blade, in which a plurality of moving blades are arranged on the rotor disk in a circumferential direction of the rotor in such an arrangement that the moving blade-side implanting portions of the moving blades are engaged with the rotor-side implanting portions, respectively, wherein gaps are formed between the moving blade-side implanting portions and the rotor-side implanting portions, respectively, in a manner such that a cooling medium flows through a gap formed at least on a blade portion side of the moving blade among the gaps.

In another aspect of the present invention, there is also provided a method for cooling a steam turbine, which includes: a casing; a rotor arranged inside the casing so as to extend in an axial direction of the casing; a rotor disk integrally formed with the rotor; a rotor-side implanting portion formed in the rotor disk; a plurality of moving blades arranged on the rotor disk in a circumferential direction of the rotor; and a moving blade-side implanting portion formed in the moving blade, in which the moving blade-side implanting portions of the moving blades are engaged with the rotor-side implanting portions, respectively, wherein a cooling medium flows through a gap formed at least on a blade portion side of the moving blade among gaps formed between the moving blade-side implanting portions and the rotor-side implanting portions.

In preferred embodiments of the above aspect, according to the present invention, the following subject matters may be additionally provided.

It may be desired that the moving blade-side implanting portion and the rotor-side implanting portion are formed in a linear shape parallel to an axial direction of the rotor, in a linear shape inclined with respect to the axial direction, or in a curved shape parallel to the axial direction so as to be moved relatively in the linear direction to be engaged with each other.

The moving blade-side implanting portion and the rotor-side implanting portion may be formed each in a fir tree shape (e.g., like a Christmas tree) with a plurality of implanting hook portions projecting from both sides of an implanting neck portion, and a cooling passage for a cooling medium to flow therethrough may be formed in a root portion of the implanting neck portion.

It may be also desired that the moving blade-side implanting portion and the rotor-side implanting portion are formed each in a fir tree shape (e.g., like a Christmas tree) with a plurality of implanting hook portions projecting from both sides of an implanting neck portion, and a cooling passage for a cooling medium to flow therethrough is formed in at least one of the implanting neck portion and the implanting hook portions. In this example, the cooling passage formed in the implanting neck portion may have an oval shape with a longitudinal direction of the implanting neck portion being a long axis direction.

According to the steam turbine and the cooling method thereof of the present invention of the characters mentioned above, even when the high-temperature steam flows as the mainstream steam, the strength and the soundness of the implanting portion of each of the moving blade and the rotor disk can be preferably and effectively ensured.

The nature and further characteristic features of the present invention will be made clearer from the following descriptions made with reference to the accompanying drawings.

DESCRIPTION OF THE PREFERRED EMBODIMENTS

In the following, preferred embodiments for carrying out the present invention will be described with reference to the accompanying drawings, but it is to be noted that the present invention is not limited to the embodiments. It is further to be noted that terms "upper", "lower", "right", "left" and the like terms are used herein with reference to the illustration of the drawings or in an actually usable state of the steam turbine.

Beforehand the explanation of preferred embodiments of the present invention, a steam turbine having a general structure will be described hereunder with reference to FIG. 7, to which the present invention is applicable.

Figure 7:
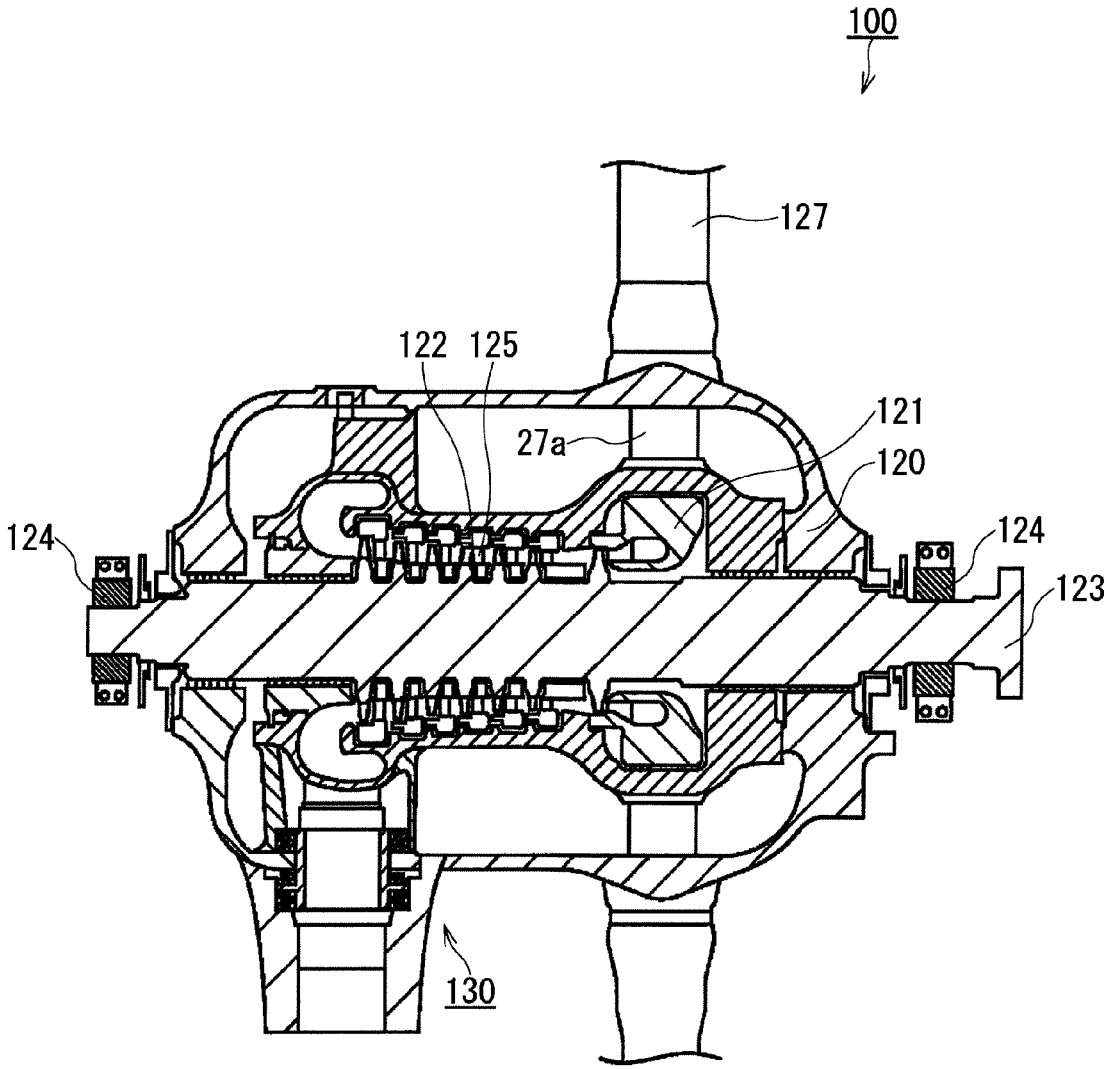
FIG. 7 is a longitudinal sectional view of a steam turbine to which the present invention is applicable.

With reference to FIG. 7, a steam turbine 100 is composed of double-casing structure including inner casing 120 and an outer casing 121 disposed outside the inner casing 120. Inside the inner casing 120, a turbine rotor 123 extends in an axially longitudinal direction of the inner casing 120, the turbine rotor 123 is supported to be rotatable by rotor bearings 124 at both longitudinal ends thereof and is provided with a rotor disk, not shown in FIG. 7.

A number of stationary blades (i.e., nozzles) 125 are arranged to be alternately arranged with moving blades (buckets) 122 in the axial direction of the turbine rotor 123. The moving blades 122 are implanted in the rotor disk in a circumferential direction of the rotor 123.

The steam turbine 100 is also provided with a main steam pipe 127, having a portion penetrating the outer casing 121, through which a main steam is introduced into the inner casing 120 and then discharged from a discharge passage 130 outside the steam turbine 100 through a steam passage formed in the inner casing 120.

First Embodiment

Figure 1:
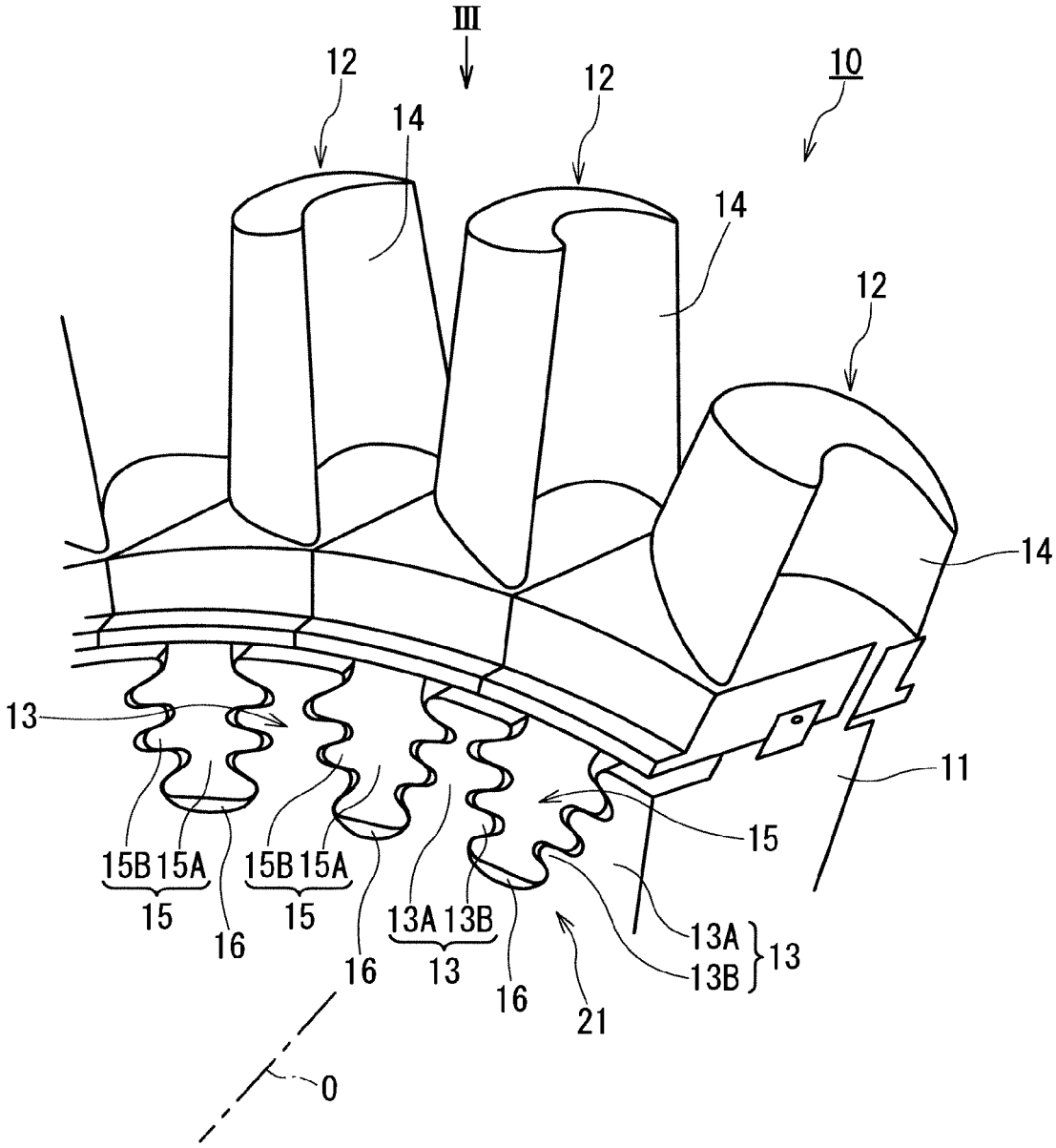
FIG. 1 is a perspective view illustrating an essential portion of a steam turbine according to a first embodiment of the present invention.
Figure 2:
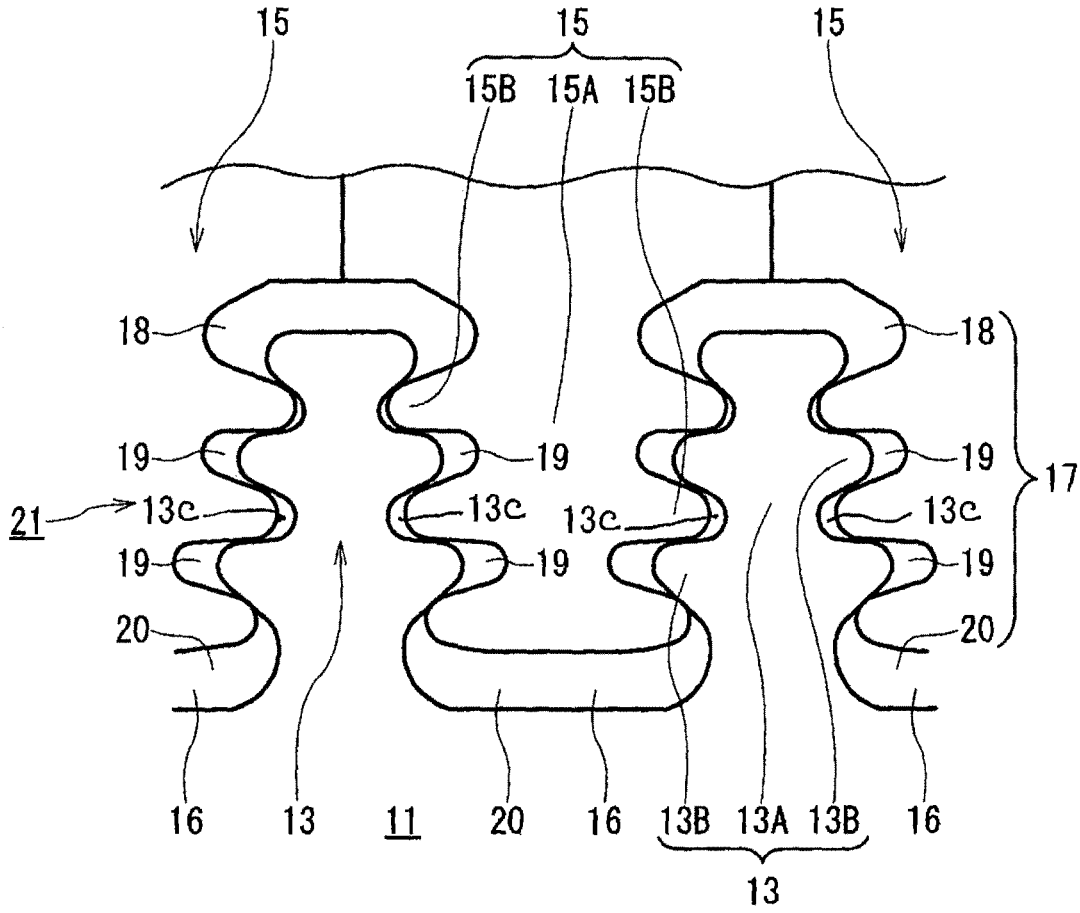
FIG. 2 is a partial front view illustrating an enlarged implanting portion of a moving blade in FIG. 1.

FIGS. 1 to 3

With reference to FIG. 1 illustrating an essential portion of a steam turbine 10 (corresponding to the steam turbine 100 in FIG. 7) according to a first embodiment of the present invention, the steam turbine 10 acts to guide high-temperature mainstream steam having a temperature of about 700 to 750° C. to a moving blade 12 through a stationary blade (nozzle) to rotate a rotor, not shown, provided with a rotor disk 11 on which a moving blade (bucket) 12 is installed so as to rotationally drive a power generator, not shown, coupled to the rotor.

Since the mainstream steam having a high temperature is utilized as described above, turbine efficiency can be improved.

The rotor disk 11 is integrally formed with the rotor and provided with a plurality of rotor-side implanting portions 13 on its outer periphery. As shown in FIGS. 1 and 2, each of the rotor-side implanting portions 13 is formed in a fir tree shape (e.g., like a Christmas tree) with a plurality of implanting hook portions 13B projecting from the both sides of an implanting neck portion 13A.

As shown in FIG. 1, the moving blade 12 includes a blade portion 14 with which the mainstream steam collides, and a moving blade-side implanting portion 15 integrally provided on the lower portion of the blade portion 14. The moving blade-side implanting portion 15 is also formed in a fir tree shape (e.g., like a Christmas tree) with a plurality of implanting hook portions 15B projecting from the both sides of an implanting neck portion 15A as shown in FIGS. 1 and 2.

Figure 3A:
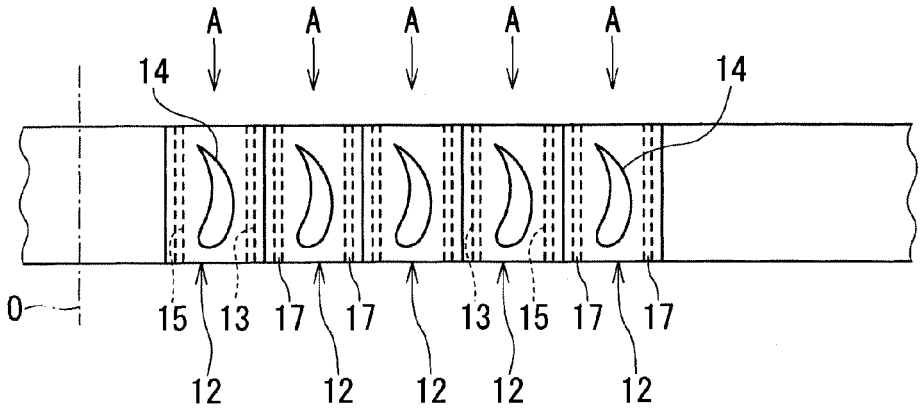
FIGS. 3A, 3B and 3C are views viewed in a direction of an arrow III in FIG. 1 illustrating a developed blade sequence of the moving blade in FIG. 1.

As shown in FIGS. 1 and 3A, the rotor-side implanting portion 13 and the moving blade-side implanting portion 15 are formed in a linear shape parallel to an axial direction "O" of the rotor. Therefore, the rotor-side implanting portion 13 and the moving blade-side implanting portion 15 are engaged with each other by relatively moving in the linear direction. That is, the moving blade-side implanting portion 15 is inserted into a groove 16 between the adjacent rotor-side implanting portions 13 from the axial direction "O" of the rotor, so that the implanting hook portions 15B of the moving blade-side implanting portion 15 are engaged with the implanting hook portions 13B of each of the rotor-side implanting portions 13. In such a manner, a plurality of moving blades 12 are firmly engaged with the rotor disk 11 in the circumferential direction of the rotor.

Meanwhile, as shown in FIGS. 1 and 2, gaps 17 for engagement are provided between the moving blade-side implanting portion 15 and the rotor-side implanting portion 13. Among these gaps 17, gaps 17 formed at least on the moving blade portion 14 side, that is, gaps 18 and 19 that are the gaps on the moving blade portion 14 side in the present embodiment, and a gap 20 that is a gap on the rotor side are used as cooling passages, thereby constituting a cooling structure 21 of the steam turbine. A cooling medium "A" (FIG. 3A) such as cooling steam flows through the gaps 18, 19 and 20.

The gap 18 is a gap formed by the adjacent moving blade-side implanting portions 15 of the adjacent moving blades 12 and the distal end of the implanting neck portion 13A of the rotor-side implanting portion 13. The gaps 19 are gaps formed between the implanting hook portions 15B of the moving blade-side implanting portion 15 and the implanting hook portions 13B of the rotor-side implanting portion 13 adjacent to each other.

Further, the gap 20 is a gap formed by the groove 16 between the adjacent rotor-side implanting portions 13 and the distal end of the implanting neck portion 15A of the moving blade-side implanting portion 15. That is, in the present embodiment, the gaps 17 on the blade portion 14 side are the gaps formed when the convex portions (the hook portions) of the moving blade-side implanting portion 15 are engaged with the concave portions (the neck portion) of the rotor-side implanting portion 13.

According to the present embodiment, the following effect (1) is obtained.

(1) As mentioned above, in the first embodiment, among the gaps 17 for attachment formed between the moving blade-side implanting portion 15 and the rotor-side implanting portion 13, all the gaps 18, 19 and 20, including the gaps 18 and 19 on the blade portion 14 side of the moving blade 12, are used as the cooling passages, and the cooling medium "A" is made to flow through the gaps 18, 19 and 20, thereby cooling the vicinity of the gaps 18, 19 and 20. Therefore, heat conducted from the blade portion 14 of the moving blade 12 is shut off or blocked from entering the moving blade-side implanting portion 15 and the rotor-side implanting portion 13, and the moving blade-side implanting portion 15 and the rotor-side implanting portion 13 can be cooled down as a whole.

Generally, a great stress is generated in the moving blade-side implanting portion 15 and the rotor-side implanting portion 13 when the rotor is rotated. Furthermore, in the steam turbine 10 in which the high-temperature steam having a temperature of about 700 to 750° C. is used, the temperatures of the moving blade-side implanting portion 15 and the rotor-side implanting portion 13 become high. Thus, there may cause a possibility that the moving blade-side implanting portion 15 and the rotor-side implanting portion 13 are reduced in material strength to an insufficient level.

In the present embodiment, the cooling medium is made to flow through the gaps 17 (the gaps 18, 19 and 20) between the moving blade-side implanting portion 15 and the rotor-side implanting portion 13, so that the moving blade-side implanting portion 15 and the rotor-side implanting portion 13 can be cooled down as a whole. Therefore, even when the high-temperature steam is used, the moving blade-side implanting portion 15 and the rotor-side implanting portion 13 can be ensured in their strength. As a result, the soundness of the moving blade-side implanting portion 15 and the rotor-side implanting portion 13, i.e., the soundness of the steam turbine 10, could be secured.

Figure 3B:
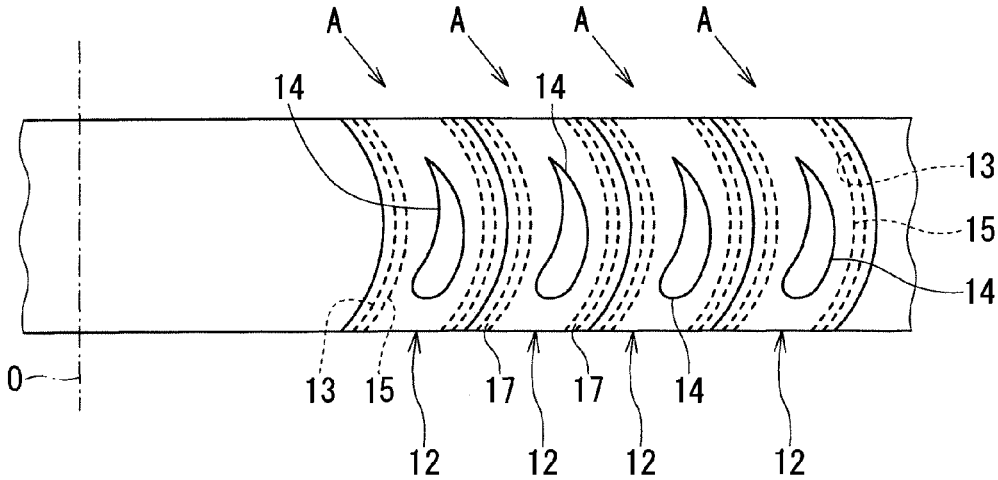
Figure 3C:
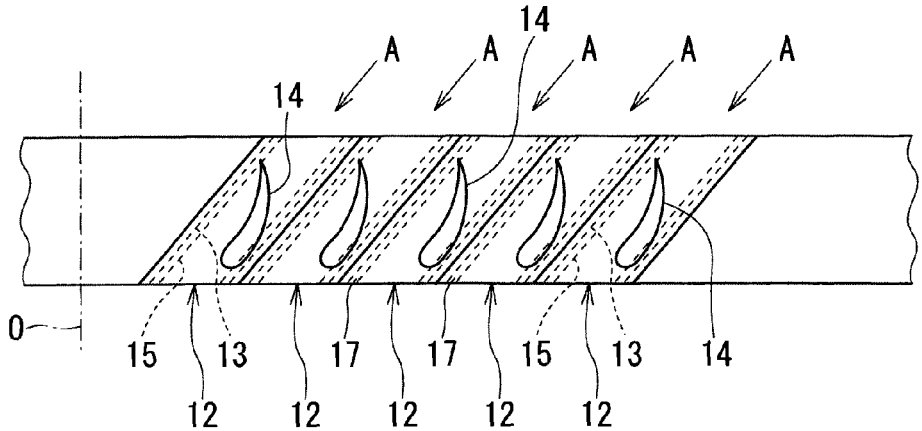

As shown in FIG. 3B, the moving blade-side implanting portion 15 and the rotor-side implanting portion 13 may be formed so as to provide a curved shape parallel to the axial direction "O" of the rotor to move relatively in the curved direction to be engaged with each other. As shown in FIG. 3C, the moving blade-side implanting portion 15 and the rotor-side implanting portion 13 may also be formed so as to provide a linear shape inclined with respect to the axial direction "O" of the rotor to move relatively in the inclined direction to be engaged with each other.

When the moving blade-side implanting portion 15 and the rotor-side implanting portion 13 are formed in a curved shape parallel to the axial direction "O" of the rotor or in a linear shape inclined with respect to the axial direction "O" as described above, the passage length of the gaps 17 (the gaps 18, 19 and 20) which function as the cooling passages and through which the cooling medium "A" flows can be extended longer than that in the case of FIG. 3A. Accordingly, the moving blade-side implanting portion 15 and the rotor-side implanting portion 13 may be cooled down more effectively.

Second Embodiment

FIG. 4

Figure 4:
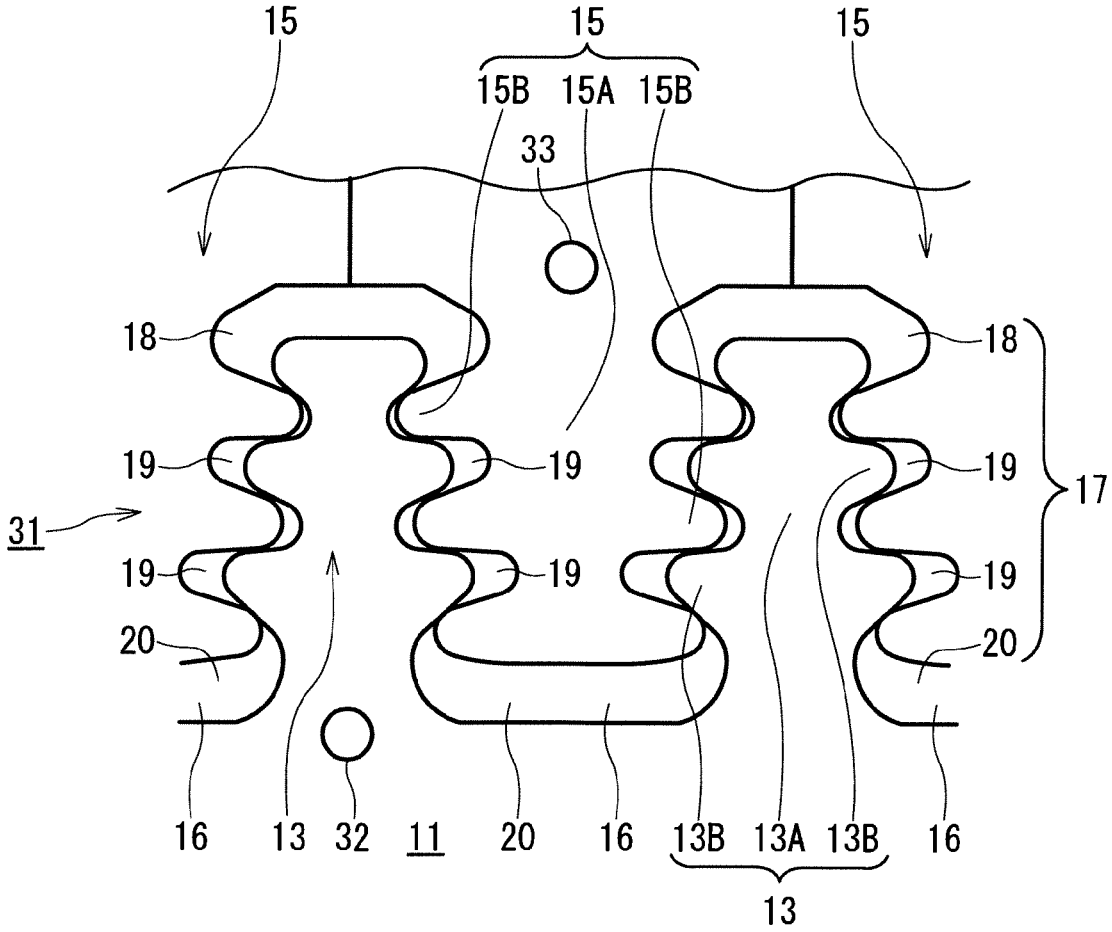
FIG. 4 is a partial front view illustrating an enlarged implanting portion of a moving blade in a steam turbine according to a second embodiment of the present invention.

FIG. 4 is a partial front view illustrating an enlarged implanting portion of a moving blade in a steam turbine according to a second embodiment of the present invention. In the illustration of the second embodiment, the like reference numerals are added to parts or components corresponding those of the first embodiment, and duplicated description is omitted herein.

A cooling structure 31 of the steam turbine according to this second embodiment is different from the cooling structure 21 of the steam turbine according to the first embodiment in that the gaps 18, 19 and 20 between the moving blade-side implanting portion 15 and the rotor-side implanting portion 13 used as the cooling passages. In addition, a cooling passage 32 is formed in a root region of the implanting neck portion 13A of the rotor-side implanting portion 13, and a cooling passage 33 is formed in a root region of the implanting neck portion 15A of the moving blade-side implanting portion 15, respectively.

The cooling passages 32 and 33 may be also formed in a linear shape parallel to the axial direction "O" of the rotor, in a curved shape parallel to the axial direction "O" or in a linear shape inclined with respect to the axial direction "O", as respectively shown in FIGS. 3A, 3B and 3C, in a manner similar to the gaps 18, 19 and 20 between the moving blade-side implanting portion 15 and the rotor-side implanting portion 13.

The cooling medium A such as cooling steam also flows through the cooling passages 32 and 33 to thereby cool the moving blade-side implanting portion 15 and the rotor-side implanting portion 13 in a manner similar to the gaps 18, 19 and 20 between the moving blade-side implanting portion 15 and the rotor-side implanting portion 13.

Therefore, according to the present embodiment, the same effect as the effect (1) in the above first embodiment can be obtained in a further improved manner since the cooling medium also flows through the cooling passages 32 and 33.

Third Embodiment

FIG. 5

Figure 5:
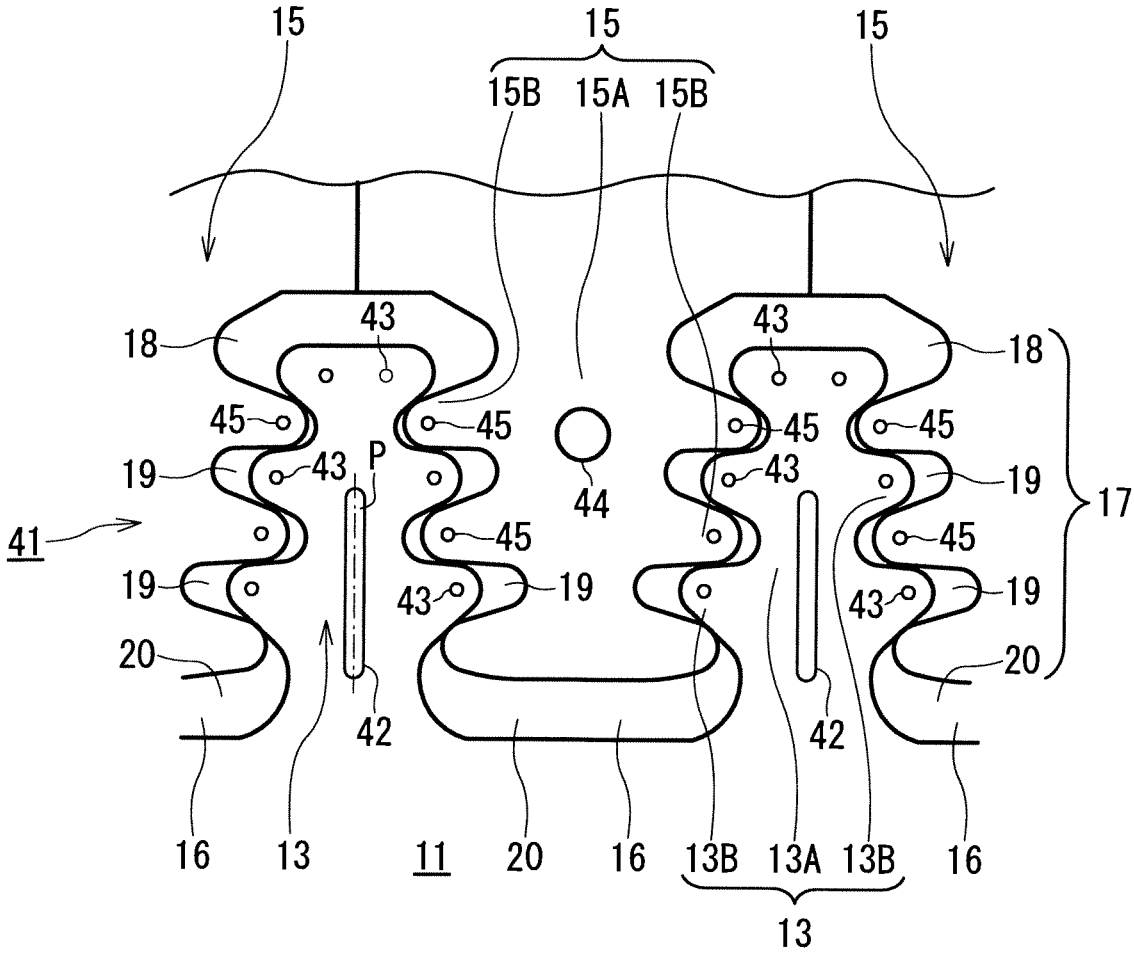
FIG. 5 is a partial front view illustrating an enlarged implanting portion of a moving blade in a steam turbine according to a third embodiment of the present invention.
Figure 6:
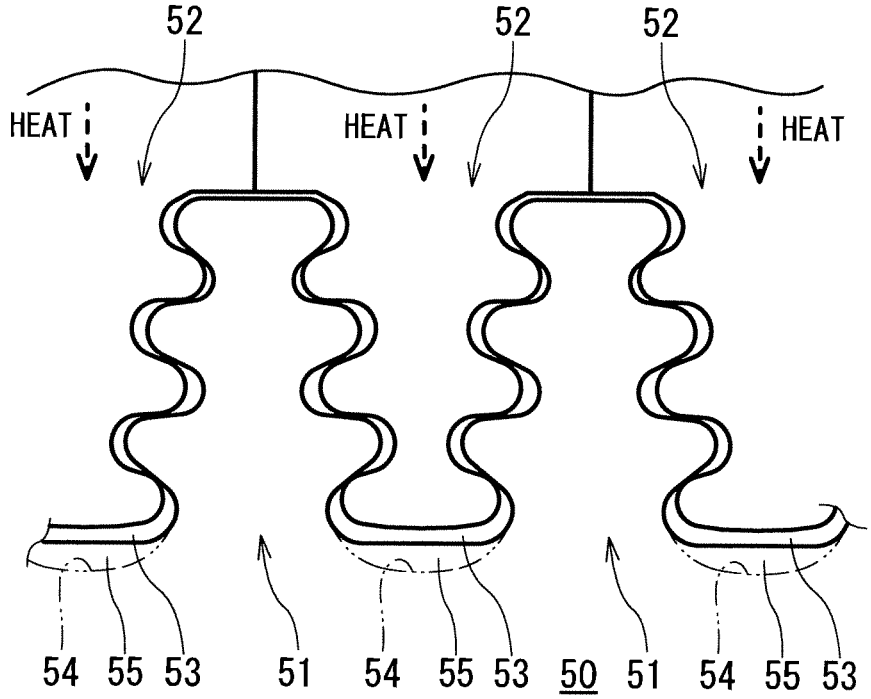
FIG. 6 PRIOR ART
FIG. 6 is a partial front view illustrating an enlarged implanting portion of a moving blade in a conventional steam turbine.

FIG. 5 is a partial front view illustrating an enlarged implanting portion of a moving blade in a steam turbine according to a third embodiment of the present invention. In the third embodiment, the like reference numerals are added to parts or components corresponding to those in the first embodiment, and duplicated description is omitted herein.

A cooling structure 41 of the steam turbine according to this third embodiment is different from the cooling structure 21 of the steam turbine of the first embodiment in that a cooling passage is formed in at least one of the implanting neck portion 13A and the implanting hook portions 13B of the rotor-side implanting portion 13 (cooling passages 42 and 43 are respectively formed in the implanting neck portion 13A and the implanting hook portions 13B in the present embodiment) and a cooling passage is formed in at least one of the implanting neck portion 15A and the implanting hook portions 15B of the moving blade-side implanting portion 15 (cooling passages 44 and 45 are respectively formed in the implanting neck portion 15A and the implanting hook portions 15B in this third embodiment) in addition to the gaps 18, 19 and 20 between the moving blade-side implanting portion 15 and the rotor-side implanting portion 13 used as the cooling passages.

The cooling passages 42 and 43 are formed in ranges so as not to affect the strength of the implanting neck portion 13A and the implanting hook portions 13B, respectively. Similarly, the cooling passages 44 and 45 are formed in ranges which do not affect the strength of the implanting neck portion 15A and the implanting hook portions 15B, respectively. The cooling passage 42 formed in the implanting neck portion 13A is formed in an oval shape in section with the longitudinal direction of the implanting neck portion 13A being a long axis direction P. Although the cooling passage 44 formed in the implanting neck portion 15A is shown to have a circular shape in section, the cooling passage 44 may be also formed in an oval shape in section similar to the cooling passage 42.

Furthermore, the cooling passages 42, 43, 44 and 45 are also formed in a linear shape parallel to the axial direction "O" of the rotor (see FIG. 3A), in a curved shape parallel to the axial direction "O" (see FIG. 3B) or in a linear shape inclined with respect to the axial direction "O" (see FIG. 3C) in a manner similar to the gaps 18, 19 and 20 between the moving blade-side implanting portion 15 and the rotor-side implanting portion 13. The cooling medium "A" such as cooling steam also flows through the cooling passages 42, 43, 44 and 45 to thereby cool the moving blade-side implanting portion 15 and the rotor-side implanting portion 13 in a manner similar to the gaps 18, 19 and 20 between the moving blade-side implanting portion 15 and the rotor-side implanting portion 13.

Therefore, according to this third embodiment, the same effect as the effect (1) in the above first embodiment can be obtained in a further improved manner since the cooling medium "A" also flows through the cooling passages 42, 43, 44 and 45 formed in the implanting neck portions 13A and 15A and the implanting hook portions 13B and 15B.

What is claimed is:

1. A steam turbine comprising:

a casing;

a rotor arranged inside the casing so as to extend in an axial direction of the casing;

a rotor disk integrally formed with the rotor;

a rotor-side implanting portion formed in the rotor disk and provided with hook portions and recessed portions alternately in arrangement;

a moving blade; and a moving blade-side implanting portion formed in the moving blade in which a plurality of moving blades are arranged on the rotor disk in a circumferential direction of the rotor and provided with hook portions and recessed portions alternately in arrangement, wherein the moving blade-side implanting portions of the moving blades and the rotor-side implanting portions are engaged with each other in a manner such that the hook portions of the rotor-side implanting portions are engaged with the moving blade-side recessed portions, respectively, each with a gap as a first gap and the hook portions of the moving blade-side implanting portions are engaged with the rotor-side recessed portions, respectively, each with a gap as a second gap, in a manner such that the second gap is smaller than the first gap, and a cooling medium flows through the first and second gaps.

2. The steam turbine according to claim 1, wherein the moving blade-side implanting portion and the rotor-side implanting portion are formed in a linear shape parallel to an axial direction of the rotor so as to be moved relatively in the linear direction to be engaged with each other.

3. The steam turbine according to claim 1, wherein the moving blade-side implanting portion and the rotor-side implanting portion are formed in a linear shape inclined with respect to the axial direction so as to be moved relatively in the linear direction to be engaged with each other.

4. The steam turbine according to claim 1, wherein the moving blade-side implanting portion and the rotor-side implanting portion are formed in a curved shape parallel to the axial direction so as to be moved relatively in the curved direction to be engaged with each other.

5. The steam turbine according to claim 1, wherein the moving blade-side implanting portion and the rotor-side implanting portion are formed each in a fir tree shape with a plurality of implanting hook portions projecting from both sides of an implanting neck portion, and a cooling passage for a cooling medium to flow therethrough is formed in a root portion of the implanting neck portion.

6. The steam turbine according to claim 1, wherein the moving blade-side implanting portion and the rotor-side implanting portion are formed each in a fir tree shape with a plurality of implanting hook portions projecting from both sides of an implanting neck portion, and a cooling passage for a cooling medium to flow therethrough is formed in at least one of the implanting neck portion and the implanting hook portions.

7. The steam turbine according to claim 6, wherein the cooling passage formed in the implanting neck portion is formed in an oval shape with a longitudinal direction of the implanting neck portion being a long axis direction.

8. A method for cooling a steam turbine, which includes: a casing; a rotor arranged inside the casing so as to extend in an axial direction of the casing; a rotor disk integrally formed with the rotor; a rotor-side implanting portion formed in the rotor disk and provided with hook portions and recessed portions alternately in arrangement; a plurality of moving blades arranged on the rotor disk in a circumferential direction of the rotor; and a moving blade-side implanting portion formed in the moving blade and provided with hook portions and recessed portions alternately in arrangement, in which the moving blade-side implanting portions of the moving blades are engaged with the rotor-side implanting portions in a manner such that the hook portions of the rotor-side implanting portions are engaged with the moving blade-side recessed portions, respectively, each with a gap as a first gap and the hook portions of the moving blade-side implanting portions are engaged with the rotor-side recessed portions, respectively, each with a gap as a second gap, in a manner such that the second gap is smaller than the first gap, the method comprising:

flowing a cooling medium through the first and second gaps.

* * * * *